US009168198B2

(12) United States Patent
Lee

(10) Patent No.: US 9,168,198 B2
(45) Date of Patent: Oct. 27, 2015

(54) SKIN-STIMULATION UNIT AND SKIN-MASSAGE APPARATUS HAVING SAME

(75) Inventor: Jong-Dae Lee, Seocho-gu (JP)

(73) Assignee: Bomtech Electronics Co., Ltd., Seoul (KR)

( * ) Notice: Subject to any disclaimer, the term of this patent is extended or adjusted under 35 U.S.C. 154(b) by 0 days.

(21) Appl. No.: 14/122,931

(22) PCT Filed: May 29, 2012

(86) PCT No.: PCT/KR2012/004216

§ 371 (c)(1),
(2), (4) Date: Nov. 27, 2013

(87) PCT Pub. No.: WO2012/165833

PCT Pub. Date: Dec. 6, 2012

(65) Prior Publication Data

US 2014/0114220 A1 Apr. 24, 2014

(30) Foreign Application Priority Data

May 27, 2011 (KR) ..... 10-2011-0050498

(51) Int. Cl.
*A61H 23/00* (2006.01)

(52) U.S. Cl.
CPC ..... *A61H 23/006* (2013.01); *A61H 2201/0153* (2013.01); *A61H 2201/1215* (2013.01); *A61H 2201/149* (2013.01); *A61H 2201/1418* (2013.01); *A61H 2201/1664* (2013.01)

(58) Field of Classification Search
CPC ..... A61H 23/00; A61H 23/02; A61H 23/006; A61H 23/0254; A61H 1/008
USPC ..... 601/97, 101, 107–111, 134–137
See application file for complete search history.

(56) References Cited

U.S. PATENT DOCUMENTS

| | | | | |
|---|---|---|---|---|
| 5,593,381 | A * | 1/1997 | Tannenbaum et al. | 601/93 |
| 6,056,707 | A * | 5/2000 | Hayashi | 601/99 |
| 7,503,923 | B2 * | 3/2009 | Miller | 606/238 |
| 2010/0036298 | A1 | 2/2010 | Fuster | |
| 2011/0118638 | A1 * | 5/2011 | Yoo et al. | 601/108 |
| 2012/0041374 | A1 * | 2/2012 | Lee | 604/173 |

FOREIGN PATENT DOCUMENTS

KR 20100000267 U 1/2010

OTHER PUBLICATIONS

K-PION Machine Translation of KR 10-0922138 (corresponds to US 2012/0041374).*

* cited by examiner

*Primary Examiner* — Justine Yu
*Assistant Examiner* — Kathrynn Reilly
(74) *Attorney, Agent, or Firm* — Blank Rome LLP

(57) ABSTRACT

Provided are a skin-stimulation unit and a skin-massage apparatus having same. The skin-stimulation unit includes a striking member for applying an impact to the skin; a cap part into which the striking member is slidably inserted; and a connecting rod having a front end connected to the striking member and a rear end connected to an external source of motive power. The connecting rod linearly reciprocates the striking member.

8 Claims, 8 Drawing Sheets

SKIN-STIMULATION UNIT AND SKIN-MASSAGE APPARATUS HAVING SAME

REFERENCE TO RELATED APPLICATION

The present application is a National Stage of PCT/KR2012/004216,filed May 29, 2012, which claims benefit of KR 10-2011-0050498 filed May 27, 2011, whose disclosures are hereby incorporated by reference in their entirety into the present disclosure.

TECHNICAL FIELD

The present invention relates to a skin-stimulation unit and a skin-massage apparatus having the same, and more particularly, to a skin-stimulation unit configured to intensively massaging a local portion of the skin, and a skin-massage apparatus having the same.

BACKGROUND ART

Generally, a skin-massage apparatus applies a predetermined stimulation on skin using, mainly, vibration, for the cosmetic purpose. The vibration-type skin-massage apparatus includes a massage probe which includes therein a small-sized vibration motor or a piezoelectric ceramic vibrator. The micro vibration or ultrasonic waves generated by the massage probe cause the skin in contact with the massage probe to vibrate several hundred times per second, to thus stimulate the skin surface and subcutaneous tissue and facilitate blood circulation of the skin and tissues.

However, the conventional vibration type skin-massage apparatus has severely deteriorated skin-massage effect particularly when vibration is weak or, when the vibration is too strong, excessive vibration of the skin-massage apparatus is directly transmitted to the hand of a massager who is at a massaging work, causing inconvenience and thus hindering working for long hours.

Meanwhile, in addition to the conventional vibration type skin-massage apparatus, a needle type skin-massage apparatus is also in use, which pricks skin to destruct the subcutaneous tissues, and thus brings in skin improvement effect as a result of natural regeneration of the destructed subcutaneous tissues. Compared to the vibration type massage apparatus, the conventional needle type skin-massage apparatus can provide higher cosmetic effect. However, the needle type gives a subject of treatment discomfort due to bleeding from the pricking and also pains that are accompanied when the skin is pricked with the needle. Accordingly, customers generally do not prefer the needle type massage apparatus.

DISCLOSURE

Technical Problem

The present invention is provided to overcome the problems mentioned above, and accordingly, the present invention provides a skin-stimulation unit configured to maximize the cosmetic effect by effectively stimulating subcutaneous tissues, i.e., by intensively massaging skin without causing pains, using repetitive linear reciprocal to and fro movement on a local area of the skin with a striking member formed from shock-absorbent material and a skin-massage apparatus having the same.

Technical Solution

To achieve the objects of the present invention, a skin-stimulation unit is provided, which may include a striking member configured to exert impact on skin, a cap part to which the striking member is slidably inserted, and a connecting rod connected at a front end to the striking member, and connected at a rear end to an external power source, to reciprocate the striking member to and fro in a linear manner.

The striking member may include a plurality of protrusions formed on a front end thereof to stimulate the skin, or the front end may protrude into a conical shape. The striking member may be formed from elastic material. Further, the striking member may include a hollow portion formed therein to buffer impact when the front end of the striking member strikes the skin.

According to the present invention, the skin-stimulation unit may additionally include a connector configured to separably connect the striking member and the connecting rod, between the striking member and the connecting rod.

The skin-stimulation unit may additionally include an airtight member having a front end connected to a rear end of the cap part in an airtight manner, and a rear end connected to an outer circumference of the connecting rod in an airtight manner to cover the connecting rod partially.

In another embodiment of the present invention, a skin-massage apparatus is provided, which may include said skin-stimulation unit, a body, to a front end of which the cap part is removably connected, a driving motor formed inside the body, and a power transmitter configured to transmit a rotary force generated from the driving motor to the connecting rod.

The skin-massage apparatus may include a cam structure configured to convert the rotary force generated at the driving motor into a linear reciprocal driving force, and a power transmitting rod configured to transmit driving force applied from the cam structure to the connecting rod.

Advantageous Effects

According to the present invention, the striking member is driven linearly in a repeated manner, to locally and intensively massage skin with a plurality of protrusions formed on a front end thereof. As a result, compared to a conventional needle type apparatus which leaves scar on the skin, it is possible to effective massage the skin and thus help regeneration of the skin.

BEST MODE

Hereinbelow, the constitution of a skin-massage apparatus according to an embodiment of the present invention will be explained with reference to the accompanying drawings.

Figure 1A:
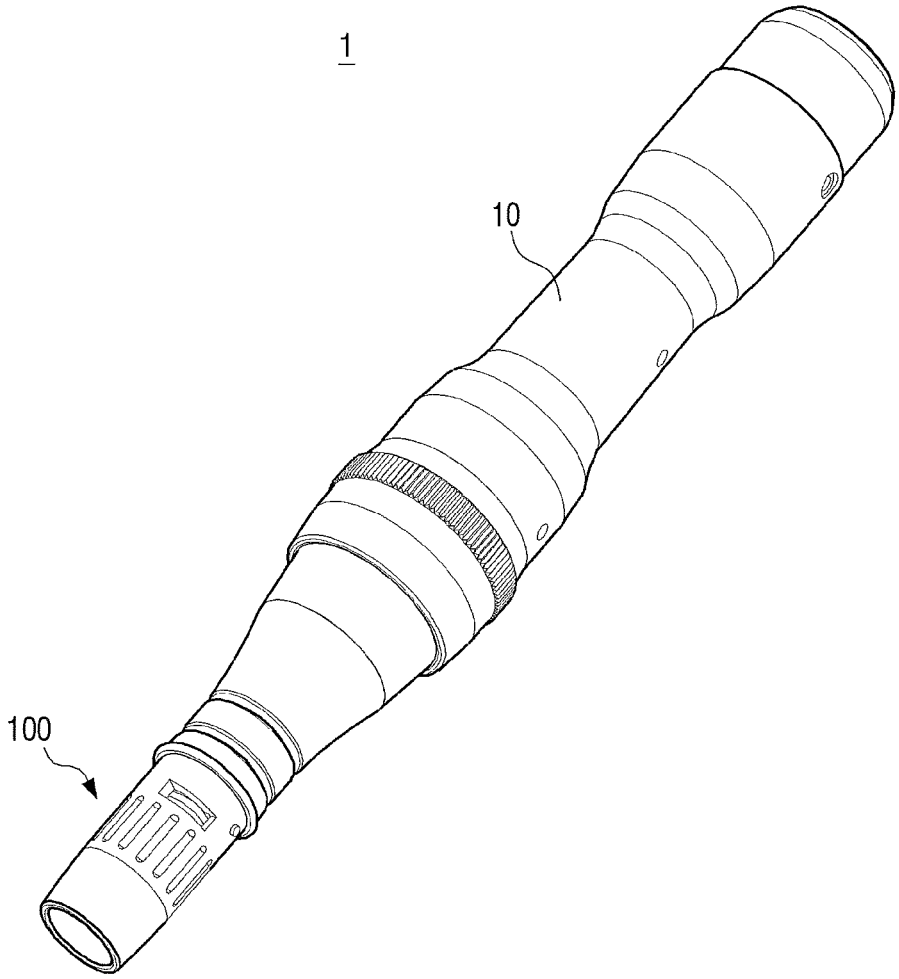
FIG. 1*a* is a perspective view of a skin-massage apparatus according to an embodiment of the present invention.

Referring first to FIG. 1*a*, the skin-massage apparatus 1 according to an embodiment of the present invention includes a body 10 and a replaceable skin-stimulation unit 100.

The body 10 is so configured to have a predetermined length to allow easy grip of a user (who is performing massaging). The body 10 includes a power structure formed therein to drive a striking member 130 (FIG. 2) of the skin-stimulation unit 100 to reciprocally move in a linear manner.

Figure 1B:
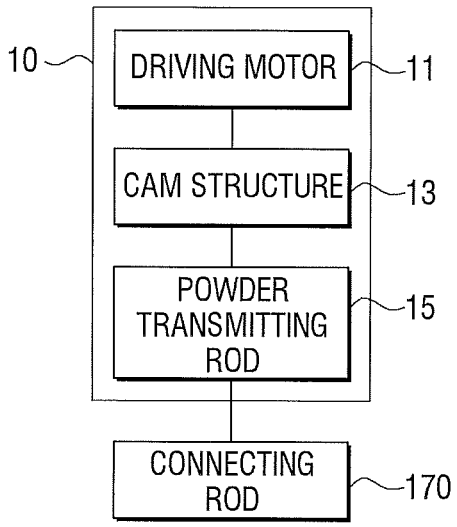
FIG. 1*b* is a block diagram of a power structure provided inside a skin-massage apparatus according to an embodiment of the present invention.

Referring to FIG. 1*b*, the power structure includes a driving motor 11, a cam structure 13, and a power transmitting rod 15. Meanwhile, the power structure to drive the striking member 130 is not limited to a specific example explained below, but may be any structure provided that the structure can drive the striking member 130 of the skin-stimulation unit 100 in a linear reciprocal movement.

The driving motor 11 receives external power and provides motive power to drive the striking member 130. The cam structure 13 converts rotary motion of the driving motor 11 into linear motion, and is engaged to a rotary shaft (not illustrated) of the driving motor 11.

The power transmitting rod 15 transmits the linear motive power converted at the cam structure 13 to the connecting rod 170 (see FIG. 2) of the striking unit 100, so that the striking member 130 linearly reciprocates to and fro repeatedly.

Figure 2:
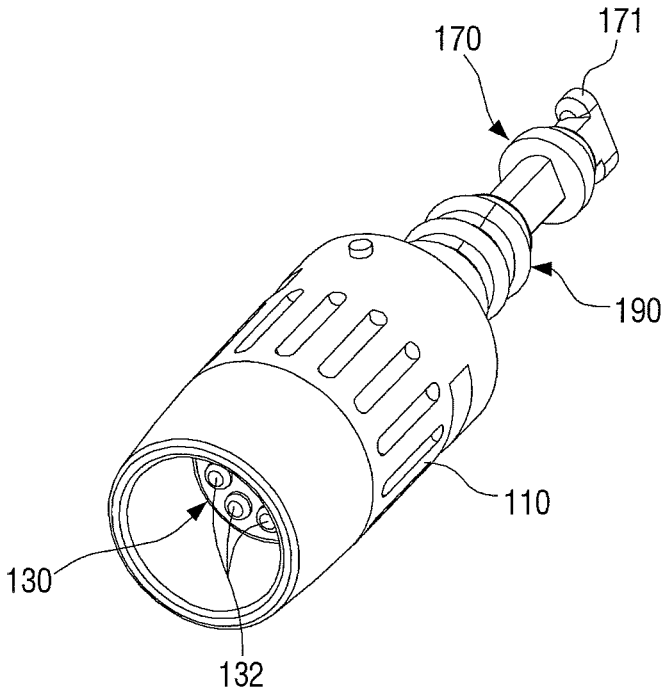
FIG. 2 is a perspective view of a skin-stimulation unit of a skin-massage apparatus in assembled state, according to an embodiment of the present invention.
Figure 3:
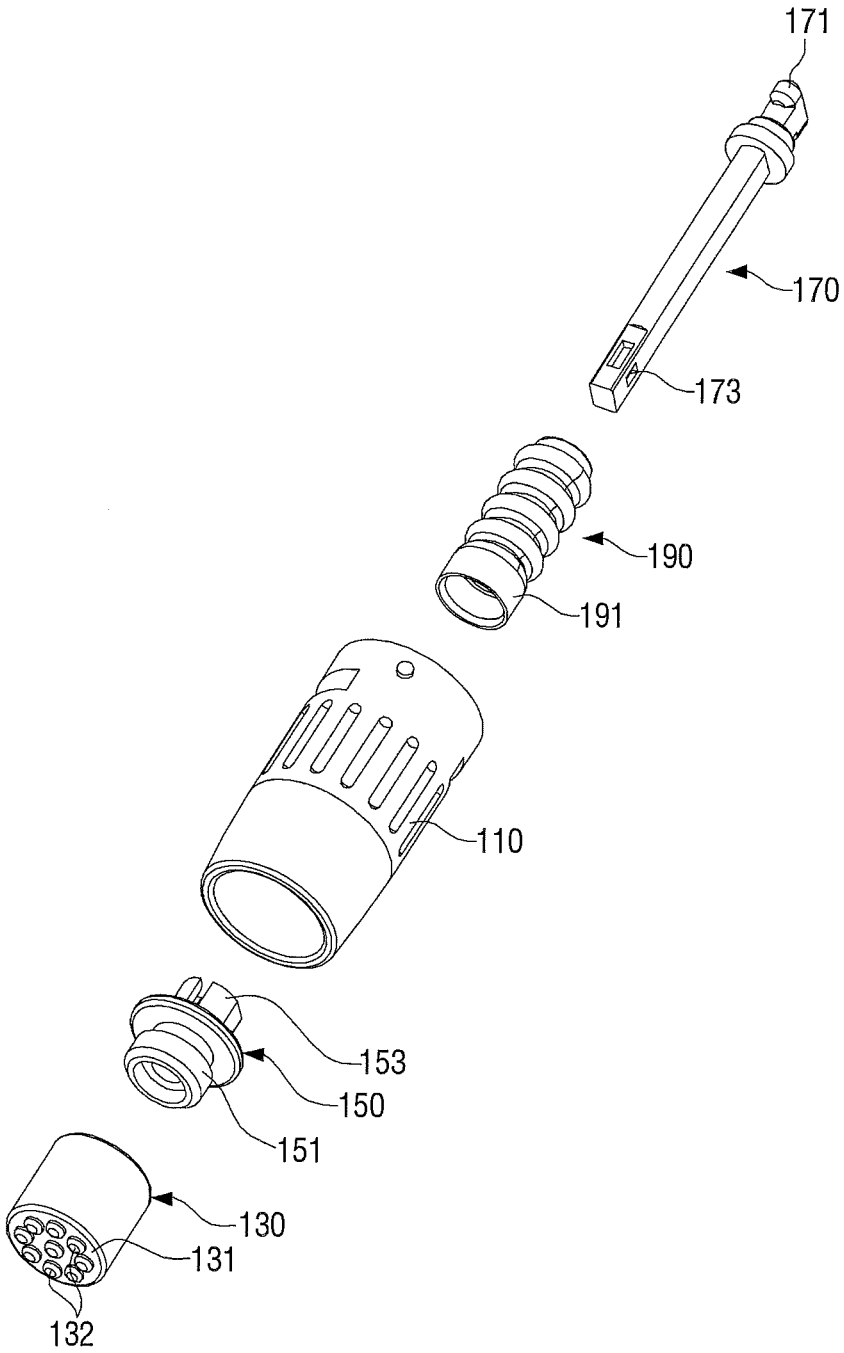
FIGS. 3 and 4 are exploded perspective view of a skin-stimulation unit of a skin-massage apparatus according to an embodiment of the present invention.
Figure 4:
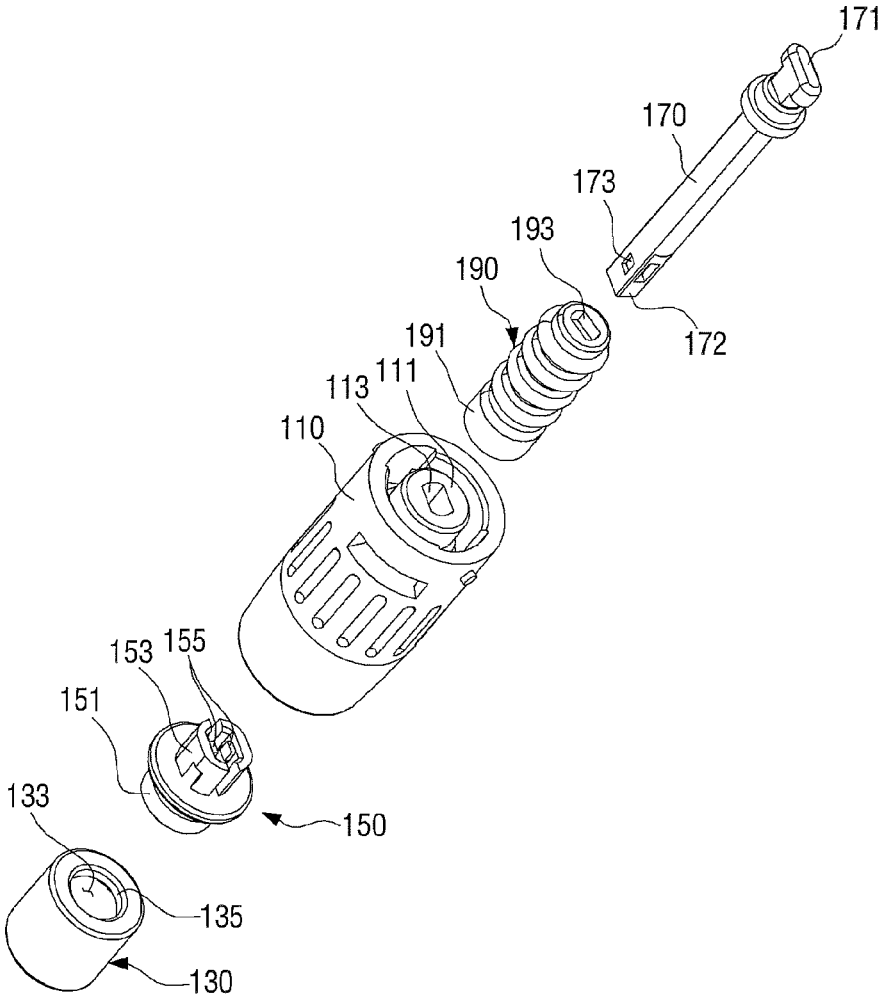

Hereinbelow, the constitution of the skin-stimulation unit 100 will be explained with reference to FIGS. 2 to 4.

The skin-stimulation unit 100 includes a cap part 110, the striking member 130, a connector 150, the connecting rod 170 and an airtight member 190.

The cap part 110 is configured to a cylinder form with open front and rear ends, in which the rear end is removably connected to the front end of the body 10. In this case, the connecting structure preferably employs a snap engagement structure or the like to allow easy separation and connection between the cap part 110 and the body 10. The striking member 130 is movably inserted into the cap part 110 to be slid along an inner side thereof.

Further, the cap part 110 forms the connecting part 111 to which a front end 191 of the airtight member 190 is connected in an airtight manner. The connecting part 111 includes a guide hole 113 pierced therein to allow the connecting rod 170 to be slid therein. The guide hole 113 thus guides the linear reciprocal movement of the connecting rod 170.

Figure 5:
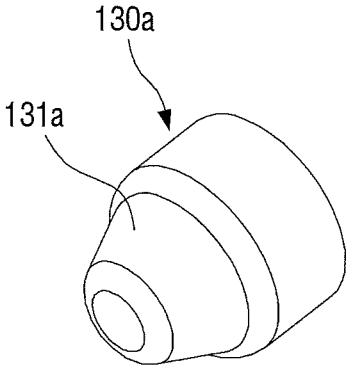
FIG. 5 is a perspective view of the striking member of FIG. 3 according to another embodiment.

The striking member 130 includes a plurality of protrusions 132 on the front end 131 to exert impact on skin during linear reciprocal driving. In this case, the front end 131 of the striking member 130 may be configured into approximately planar shape, but not limited thereto. Accordingly, the front end 131 of the striking member 130 may have hemispheric or gentle curve form. Meanwhile, referring to FIG. 5, the striking member 130*a* may be so configured that the middle of the front end 131*a* protrudes into approximately conical shape.

The striking member 130 includes a hollow portion 133 formed therein to reduce weight. As explained above, by reducing the weight of the striking member 130, it is possible to minimize the vibration transmitted to the body by the inertia. As a result, the user can easily grip the skin-massage apparatus 1.

Further, the striking member 130 is formed from rubber and synthetic resin material with a predetermined elastic force so as to intrinsically have elastic force. By doing so, it is possible to maximize skin-stimulation effect and minimize pains that can generated on skin, when the striking member 130 strikes to exert impact on the skin.

The connector 150 is slidably arranged inside the cap part 110, while interconnecting the striking member 130 and the connecting rod 170. The front end 151 of the connector 150 is removably snap-engaged with a connecting hole 135 of the striking member 130. According to the connection of the front end 151 of the connector 150 and the connecting hole 135 of the striking member 130, the hollow portion 133 of the striking member 130 is automatically sealed, and as a result, this acts as a predetermined air cushion that can effectively buffer the impacts when the striking member 130 strikes skin.

Further, the connector 150 includes a rear end 153 to be removably engaged with the front end 172 of the connecting rod 170. In this case, the rear end 153 of the connector 150 includes a connecting protrusion 155 for snap-engagement into the connecting hole 173 formed in the front end 172 of the connecting rod 170.

The rear end 171 of the connecting rod 170 is removably connected with the power transmitting rod 150 to linearly reciprocate the striking member 130 to and fro, via the connector 150.

The airtight member 190 is formed from an elastic material and includes a corrugate portion such as flexible pipe formed on an outer circumference thereof. The airtight member 190 is arranged between the cap part 110 and the connecting rod 170, and additionally plays a role of preventing ingress of liquid such as oil for skin care purpose applied on the skin during skin-massage along the surface of the connecting rod 170 into the interior of the body 10. To that purpose, the connecting portion 111 of the cap part 110 is force-fit in the front end 191 of the airtight member 190 in an airtight manner, and part of the connecting rod 170 to be inserted in a passing hole 193 formed in the rear end of the airtight member 191 is also force-fit in the passing hole 193.

Figure 6:
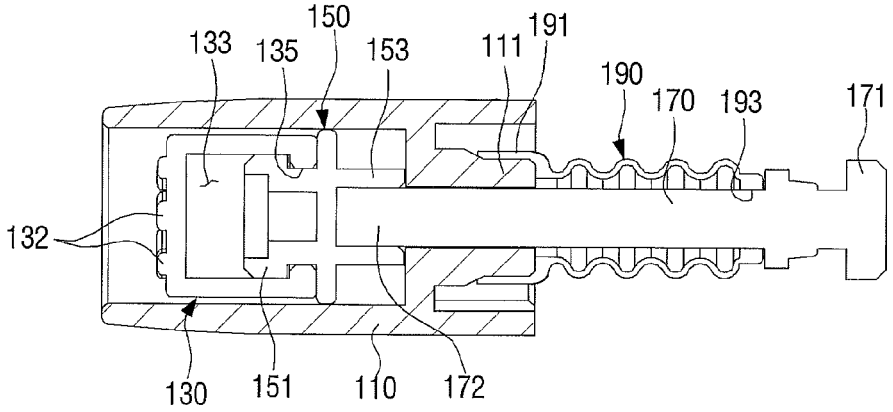
FIGS. 6 and 7 are cross section views of the striking member of FIG. 2 linearly reciprocating to and fro.
Figure 7:
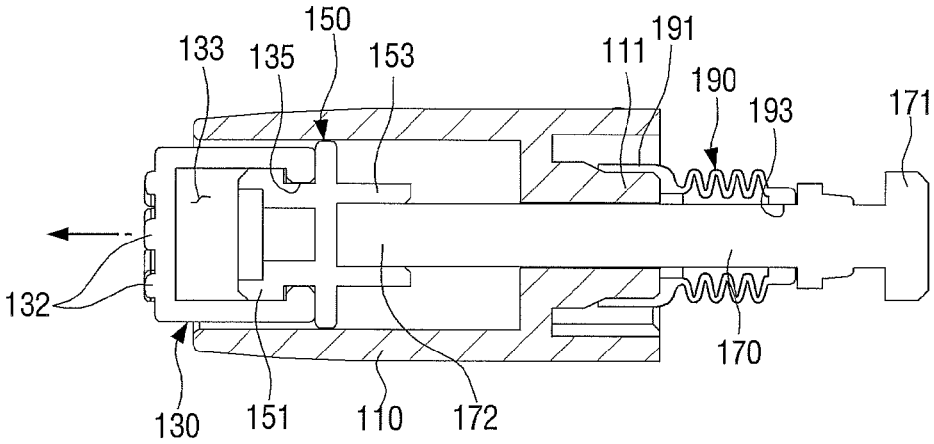

Referring to FIGS. 6 and 7, the operation of the skin-massage apparatus 1 constructed as exemplified above according to the present invention will be explained.

Referring first to FIG. 6, in an initial state, the striking member 130 is so arranged that the striking member 130 is not protruded outside the cap part 110. Then when power (e.g., external power or power from battery mounted inside the body 10) to the skin-massage apparatus 1, the driving motor 11 drives, and accordingly, the driving force to cause linear reciprocal movement is transmitted o the connecting rod 170 via the cam structure 13 and the power transmitting rod 15 of the driving motor 11.

Referring to FIG. 7, the driving force moves the connecting rod 170 forward, to thus protrude the striking member 130 outside the cap part 110 by a predetermined length. Accordingly, the striking member 130 exerts impact on the skin, and a plurality of protrusions 132 of the striking member 130 intensively stimulate the subcutaneous tissues under skin. At the same time, the airtight member 190 of the striking member 130 keeps compressed state.

Next, the connecting rod 170 is moved backward by the power transmitting rod 15, causing the striking member 130 to enter into the cap part 110 as illustrated in FIG. 6.

As explained above, the striking member 130 can intensively massage local area of the skin with repetitive linear reciprocal movement. As a result, compared to the conventional method using needle, it is possible to help skin regeneration by effectively stimulating skin without causing any scar on the skin.

The foregoing exemplary embodiments and advantages are merely exemplary and are not to be construed as limiting the exemplary embodiments. The present teaching can be readily applied to other types of apparatuses. Also, the description of the exemplary embodiments of the present inventive concept is intended to be illustrative, and not to limit the scope of the claims.

INDUSTRIAL APPLICABILITY

The skin-stimulation unit and skin-massage apparatus having the same according to the present invention can be applied as an apparatus for skin care purpose, which can massage skin by stimulating the same.

The invention claimed is:

1. A skin-stimulation unit, comprising:

a striking member configured to exert impact on skin by reciprocating in a linear manner, the striking member comprising a hollow portion;

a cap part into which the striking member is slidably inserted;

a connecting rod, connected at a front end of the connecting rod to the striking member and connected at a rear end of the connecting rod to an external power source, to reciprocate the striking member in a linear manner; and a connector between the striking member and the connecting rod configured to separably connect the striking member and the connecting rod, wherein a front end of the connector is inserted into the hollow portion of the striking member which maintains an airtight state between the connector and the striking member and the front end of the connector is removably snap-engaged with a connecting hole of the striking member, wherein the striking member comprises a plurality of protrusions formed on a front end of the striking member to stimulate the skin, wherein the striking member is formed from elastic material, wherein each of the plurality of protrusions comprises a hollow portion to buffer impact when the front end of the striking member strikes the skin, wherein the connector comprises a projecting part which is formed adjacent to the front end of the connector, and wherein a rear end of the connecting hole of the striking member is coupled to a groove formed between the front end of the connector and the projecting part so that when the striking member strikes the skin the rear end of the connecting hole of the striking member is supported by the projecting part to maintain the hollow portion.

2. The skin-stimulation unit of claim 1, further comprising an airtight member comprising a front end of the airtight member connected to a rear end of the cap part in an airtight manner, and a rear end of the airtight member connected to an outer circumference of the connecting rod in an airtight manner to partially cover the connecting rod.

3. A skin-stimulation unit, comprising:

a striking member configured to exert impact on skin by reciprocating in a linear manner, the striking member comprising a hollow portion;

a cap part into which the striking member is slidably inserted;

a connecting rod, connected at a front end of the connecting rod to the striking member and connected at a rear end of the connecting rod to an external power source, to reciprocate the striking member in a linear manner; and a connector between the striking member and the connecting rod configured to separably connect the striking member and the connecting rod, wherein a front end of the connector is inserted into the hollow portion of the striking member which maintains an airtight state between the connector and the striking member and the front end of the connector is removably snap-engaged with a connecting hole of the striking member, wherein the striking member comprises a front end of the striking member protruding into a conical shape, wherein the striking member is formed from elastic material, wherein the front end of the striking member comprises a hollow portion to buffer impact when the front end of the striking member strikes the skin, wherein the connector comprises a projecting part which is formed adjacent to the front end of the connector, and wherein, a rear end of the connecting hole of the striking member is coupled to a groove formed between the front end of the connector and the projecting part so that when the striking member strikes the skin, the rear end of the connecting hole of the striking member is supported by the projecting part to maintain the hollow portion.

4. The skin-stimulation unit of claim 3, further comprising an airtight member comprising a front end of the airtight member connected to a rear end of the cap part in an airtight manner, and a rear end of the airtight member connected to an outer circumference of the connecting rod in an airtight manner to partially cover the connecting rod.

5. A skin-massage apparatus, comprising:

a skin-stimulation unit comprising;

a striking member configured to exert impact on skin;

a cap part into which the striking member is slidably inserted;

a connecting rod, connected at a front end of the connecting rod to the striking member and connected at a rear end of the connecting rod to an external power source, to reciprocate the striking member in a linear manner;

a connector between the striking member and the connecting rod configured to separably connect the striking member and the connecting rod, wherein a front end of the connector is inserted to a hollow portion of the striking member which maintains an airtight state between the connector and the striking member and the front end of the connector is removably snap-engaged with a connecting hole of the striking member, wherein the striking member comprises a plurality of protrusions formed on a front end of the striking member to stimulate skin, wherein the striking member is formed from elastic material, wherein each of the plurality of protrusions comprises a hollow portion to buffer impact when the front end of the striking member strikes the skin, wherein the connector comprises a projecting part which is formed adjacent to the front end of the connector, and wherein, a rear end of the connecting hole of the striking member is coupled to a groove formed between the front end of the connector and the projecting part so that when the striking member strikes the skin, the rear end of the connecting hole of the striking member is supported by the projecting part to maintain the hollow portion; and a body including a front end of the body, wherein the cap part is removably connected to the front end of the body.

6. The skin-massage apparatus of claim 5, further comprising an airtight member comprising a front end of the airtight member connected to a rear end of the cap part in an airtight manner, and a rear end of the airtight member connected to an outer circumference of the connecting rod in an airtight manner to partially cover the connecting rod.

7. A skin-massage apparatus, comprising:

a skin-stimulation unit comprising;

a striking member configured to exert impact on skin;

a cap part into which the striking member is slidably inserted;

a connecting rod, connected at a front end of the connecting rod to the striking member and connected at a rear end of the connecting rod to an external power source, to reciprocate the striking member in a linear manner;

a connector between the striking member and the connecting rod configured to separably connect the striking member and the connecting rod, wherein a front end of the connector is inserted to a hollow portion of the striking member which maintains an airtight state between the connector and the striking member and the front end of the connector is removably snap-engaged with a connecting hole of the striking member, wherein the striking member comprises a front end of the striking member protruding into a conical shape, wherein the striking member is formed from elastic material, wherein the front end of the striking member comprises a hollow portion to buffer impact when the front end of the striking member strikes the skin, wherein the connector comprises a projecting part which is formed adjacent to the front end of the connector, and wherein, a rear end of the connecting hole of the striking member is coupled to a groove formed between the front end of the connector and the projecting part so that when the striking member strikes the skin, the rear end of the connecting hole of the striking member is supported by the projecting part to maintain the hollow portion; and a body including a front end of the body, wherein the cap part is removably connected to the front end of the body.

8. The skin-massage apparatus of claim 7, further comprising an airtight member comprising a front end of the airtight member connected to a rear end of the cap part in an airtight manner, and a rear end of the airtight member connected to an outer circumference of the connecting rod in an airtight manner to partially cover the connecting rod.

* * * * *